United States Patent [19]

Cosson et al.

[11] Patent Number: 4,640,188

[45] Date of Patent: Feb. 3, 1987

[54] SILK SCREEN TRANSFER PRINTING APPARATUS FOR CYLINDRICAL OBJECTS

[76] Inventors: Colin Cosson, 38 Sidney Road, Rugby, Warwickshire; Laurence E. Hopper, 34 Lauds Road, Crick, Northampton, NN6 7TJ, both of England

[21] Appl. No.: 741,503

[22] Filed: Jun. 5, 1985

[30] Foreign Application Priority Data

Jun. 5, 1984 [GB] United Kingdom ..... 8414295

[51] Int. Cl.[4] ..... B41F 17/22

[52] U.S. Cl. ..... 101/39

[58] Field of Search ..... 101/35, 38 R, 38 A, 101/39, 40, 41, 44, 163, 150, 114, 129, 126

[56] References Cited

U.S. PATENT DOCUMENTS

| | | | |
|---|---|---|---|
| 1,892,545 | 12/1932 | Ward | 101/40 X |
| 2,562,168 | 7/1951 | Blanchette | 101/40 |
| 2,731,912 | 1/1956 | Welsh | 101/129 |
| 2,737,886 | 3/1956 | Ruppel | 101/40 X |
| 3,255,695 | 6/1966 | Johnson et al. | 101/211 |
| 3,276,358 | 10/1966 | Lusher | 101/129 |
| 3,593,661 | 7/1971 | Tripp | 101/40 X |
| 3,688,695 | 9/1972 | James | 101/44 X |
| 3,990,364 | 11/1976 | Paans | 101/129 |
| 4,440,589 | 4/1984 | Lock | 101/38 R X |
| 4,473,008 | 9/1984 | Heyman | 101/150 X |

FOREIGN PATENT DOCUMENTS

| | | | |
|---|---|---|---|
| 1117951 | 6/1968 | United Kingdom | 101/40 |

*Primary Examiner*—Clifford D. Crowder

*Attorney, Agent, or Firm*—Pollock, VandeSande & Priddy

[57] ABSTRACT

Spark plug insulators are mounted vertically around the edge of a horizontal turntable. A screen printing head is arranged horizontally above a print transfer drum that is rotatable about a horizontal axis. Pads of a relatively hard resilient material are disposed about the drum. The printing head is brought down into contact with the top, horizontal pad on the drum, so that the pad takes up ink, and the drum is then rotated to a vertical position. As the turntable is rotated, a pair of rollers are urged by a cam surface into contact with the insulator, rolling the insulator along the vertical print transfer pad to take up ink from the pad. The ink is ceramic-based in a thermoplastic carrier. The printing head is heated by passing current through a conductive screen so as to render the ink flowable, the print transfer pads being heated to maintain the ink flowable until it is deposited on the insulator.

6 Claims, 2 Drawing Figures

SILK SCREEN TRANSFER PRINTING APPARATUS FOR CYLINDRICAL OBJECTS

BACKGROUND OF THE INVENTION

This invention relates to printing apparatus and methods.

The invention is more particularly related to screen printing apparatus and methods.

In the manufacture of spark plugs, it is common practice to print a legend on the ceramic insulator body giving details, such as, the name of the manufacturer, a trade mark, size information and so on. Because the insulator is usually of a white or pink colour, any dark coloured printing on the insulator will be readily visible.

Various problems are met in printing on these insulator bodies. For example, the curved surface of the insulator complicates the printing process and makes it more difficult to print to a high quality. Because the print must be capable of withstanding the high temperatures met during subsequent manufacturing stages, and during use, the ink is usually ceramic-based making it highly abrasive and thereby leading to a high wear on those parts of the printing apparatus coming into contact with the ink.

Usually, the insulator is printed after glazing of the insulator, the printed insulator being subsequently fired to bake on the ink. This requires two firing operations: one to bake the glaze, and the other to bake the printing, thereby leading to increased production time. If the insulator could be glazed after printing, only one firing process would be needed during which both the ink and glaze would be fired at the same time. The difficulty with this is that the insulator is preferably arranged vertically while the glaze is sprayed on, so as to ensure even glazing. The vertical arrangement of the insulator does not, however, lend itself readily to the printing operation, especially with screen printing since the ink will flow off the printing head.

Another difficulty with previous printing processes is that, because the ink takes an appreciable time to dry, the overall production time is lengthened. This also makes it difficult to print in several colours since time must be left between the printing of each colour for the ink to dry.

BRIEF SUMMARY OF THE INVENTION

It is an object of the present invention, in one or other of its several aspects, to provide a printing apparatus or printing method by which one or more of the above-mentioned difficulties can be substantially alleviated.

According to one aspect of the present invention there is provided printing apparatus adapted for printing onto a substantially vertical surface of a body, including a screen printing head arranged substantially horizontally; a print transfer device having a print transfer pad, said transfer pad being arranged for angular displacement between a first position in which a face of the pad is substantially horizontal and can be brought into contact with the printing head so as to take up ink from the printing head, and a second position in which the pad is substantially vertical and can be brought into contact with the body so as to deposit ink on the body; and means for rolling the body relative to the pad, in contact with the pad, so that the ink is deposited over the surface.

In this way, it is possible to print onto a substantially vertical surface by using a screen printing technique whilst enabling the screen printing head to be maintained horizontal and thereby avoiding any problems with the ink flowing away from the screen.

The print transfer device may include a drum that is rotatable about a horizontal axis and that has a plurality of transfer pads spaced about its surface. The printing head may be displaceable vertically, towards and away from the print transfer device. Preferably each transfer pad is of a relatively hard resilient material and may have a Shore hardness of between about 55 to 60. The body may be mounted for free rotation about a vertical axis of the body and may be mounted towards the edge of a horizontal turntable that is rotatable about a central vertical axis of the turntable. Preferably the body is rolled along the transfer pad by roller means that engages the body on a side opposite the pad, and engages a part of the body that is not contacted by the pad as the body is rolled relative to the pad. A cam surface may be arranged to engage the roller means and urge said roller means into contact with said body. Each pad may have an end tapered away from the body. The body may be a cylindrical insulator of a spark plug and the ink in the printing head may be ceramic based.

Preferably the screen printing head includes heating means arranged to heat a heat-flowable ink in the printing head, and the print transfer device includes heating means arranged to heat the print transfer device such as to maintain ink on the print transfer device in a flowable state until it is transferred to the body to be printed. The screen printing head may include an electrically-conductive screen, the ink being heated by passing current through the screen. The ink may have a thermoplastic carrier.

According to another aspect of the present invention there is provided printing apparatus including a screen printing head and a print transfer device that is arranged to contact the screen printing head to take up ink from the screen printing head and to transfer it to a surface to be printed, the printing head including heating means arranged to heat a heat-flowable ink in the printing head, and the print transfer device including heating means arranged to heat the print transfer device such as to maintain ink on the print transfer device in a flowable state until it is transferred to the surface to be printed.

It is possible, by using this other aspect of the present invention, to reduce substantially the time taken for the ink on the printed surface to dry. This enables the overall production time to be reduced, can make it unnecessary to provide drying chambers, and can greatly facilitate printing in more than one colour.

According to a further aspect of the present invention there is provided a method of printing onto a substantially vertical surface of a body comprising the steps of bringing a print transfer pad into contact with a substantially horizontal screen printing head so as to take up ink from the screen, displacing the pad angularly to a substantially vertical position, bringing the surface of the body into contact with the transfer pad, and rolling the body relative to the pad to deposit ink from the pad over the surface.

According to yet another aspect of the present invention there is provided a method of printing in which a screen printing head is heated to maintain a heat-flowable ink in the printing head in a flowable state, contacting the printing head with a print transfer device so as to take up ink from the screen printing head, heating the print transfer device to maintain ink on the print transfer device in a flowable state, and displacing the print transfer device so as to transfer ink on the print transfer device to a surface to be printed.

Printing apparatus for printing on spark plug insulators, and a method of printing such insulators will now be described, by way of example, with reference to the accompanying drawings.

DETAILED DESCRIPTION

Figure 1:
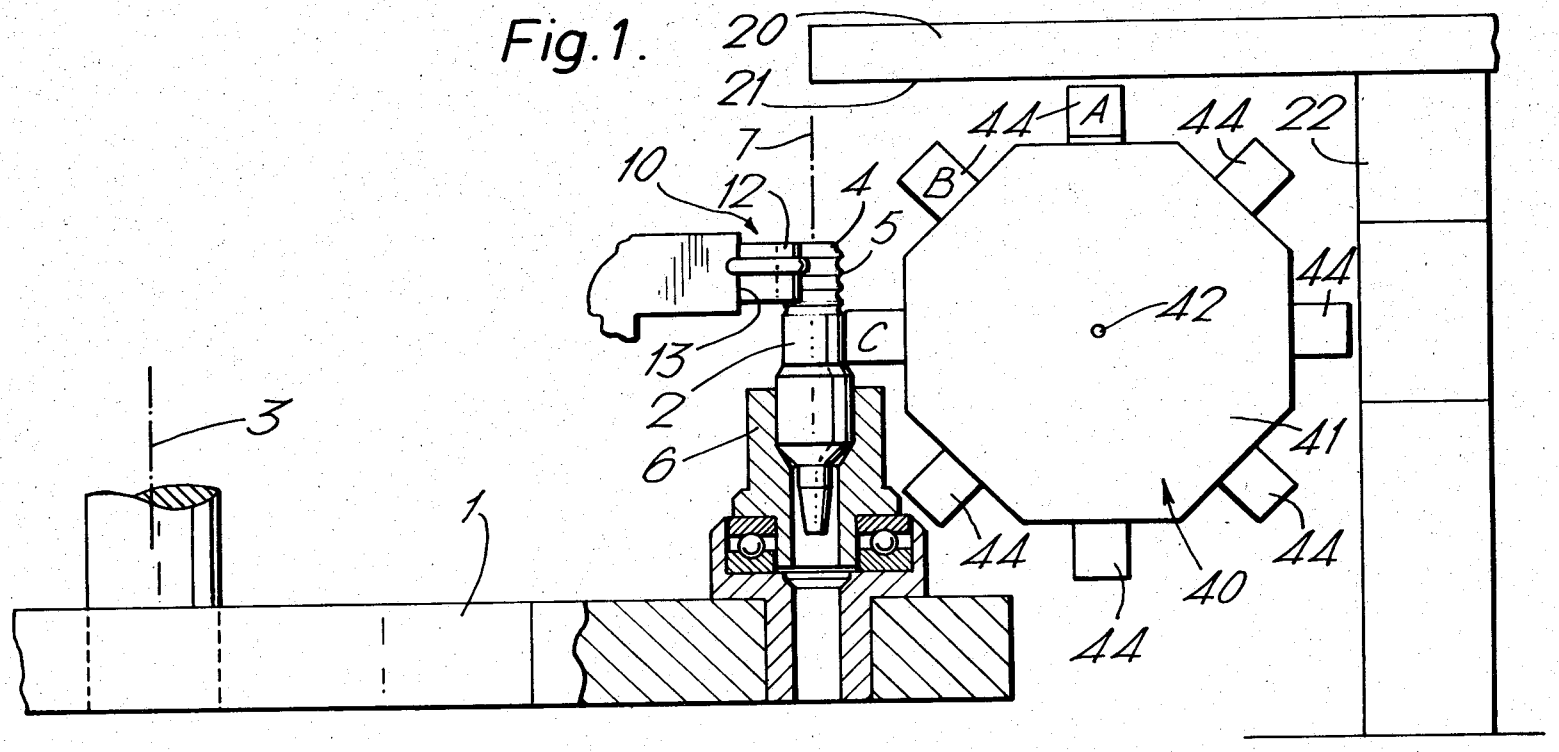
FIG. 1 is a side elevation of the apparatus.
Figure 2:
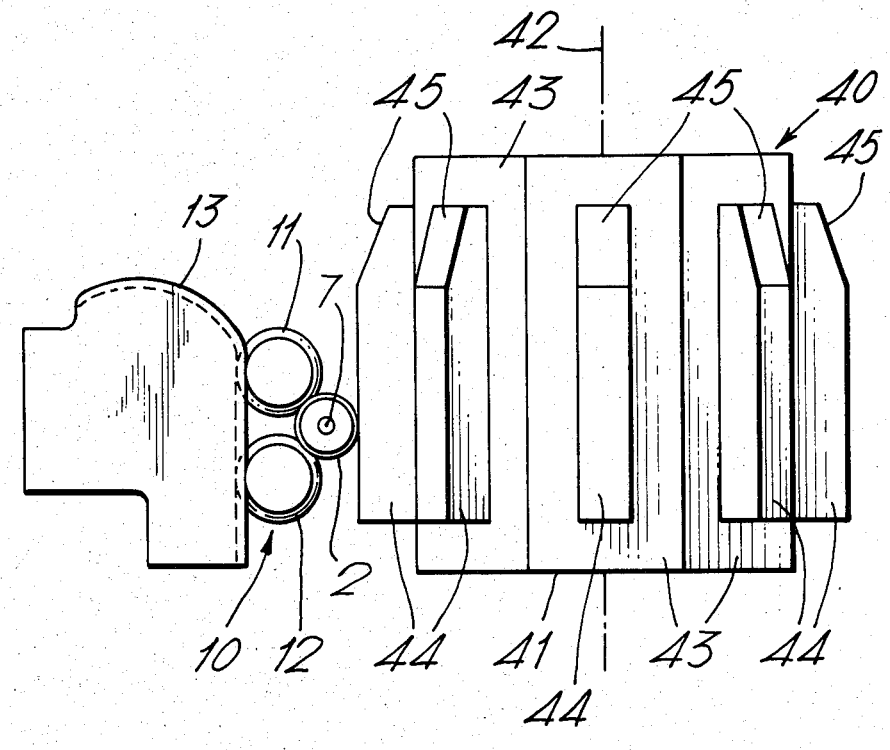
FIG. 2 is a plan view of a part of the apparatus.

The apparatus comprises a turntable 1, on which are mounted several spark plug (igniter) insulators 2, a printing head 20, and a print transfer device 40 which transfer ink from the printing head to each of the insulators in turn.

The turntable 1 is circular in shape and is arranged horizontally for rotation about a central, vertical axis 3. A drive mechanism, not shown, indexes the turntable 1 around its axis 3 so that each insulator 2 is brought in turn to the next station. In this respect, the turntable may have several different stations at which various different functions are performed such as: placing the insulator on, or removing the insulator from the turntable; machining the insulator; checking the insulator; spraying glaze on the insulator, and so on. Since the present invention is concerned with the printing operation, this is the only station that will be described.

Each spark plug insulator 2 (only one of which is shown) is of conventional form, being generally cylindrical in shape and provided with a corrugated upper end 4 formed by circumferential ribs 5 on its outer surface.

The insulators 2 are supported vertically at their lower ends in a cup 6 that is journalled with the turntable 1, close to its outer edge, so that the insulator is free to rotate about its vertical, longitudinal axis 7 parallel with the turntable axis 3. Mounted on the turntable 1, inwardly of each insulator 2, is a spring-loaded roller assembly 10. Each roller assembly 10 comprises two rollers 11 and 12 arranged side-by-side, which are normally urged inwardly of the turntable 1, out of contact with the insulator 2. When, however, the turntable 1 is indexed to bring an insulator 2 to the print transfer device 40, the inner sides of the rollers 11 and 12 engage a stationary surface 13 along which they roll and are urged outwardly, thereby contacting the corrugated upper end 4 of the insulator. This causes a corresponding rotation of the insulator 2.

At the printing station, the printing head 20 is mounted horizontally and is preferably a conventional screen printing head of the kind that uses a screen or mesh 21 of silk, nylon or other material coated to be impervious except in regions defining the pattern to be printed. Within the printing head 20, but not shown in the drawings, is an ink reservoir and a squeegee or roller mechanism for wetting the upper side of the mesh with ink. For this application the ink is preferably ceramic based. Such inks are highly abrasive and, whilst they can cause rapid wear of some printing heads, the screen printing head is less rapidly eroded because the ink passes straight through the screen. The horizontal arrangement of the printing head 20 ensures that ink is maintained evenly distributed over the screen and does not flow to a localised region under gravity. The underside of the mesh 21 is thereby maintained wetted by the ink that flows through the mesh in the pattern to be printed. The printing head 20 is supported on a vertical pillar 22, the head being arranged so that it can be raised and lowered so as respectively to clear the print transfer device 40 and to come into contact with it.

The print transfer device 40 acts to transfer the ink, in the pattern formed on the underside of the printing head 20, to the insulator 2. The print transfer device 40 has an octagonal drum 41 that is supported on a horizontal axis 42 about which it is indexed 45 degrees at a time. On each facet 43 of the drum 41 is mounted a print transfer pad 44 of a resilient but relatively hard material such as urethane, with a Shore hardness of about 55 to 60. The pads 44 extend parallel to the axis 42 of the drum 41 being tapered away from the insulator 2 to a reduced thickness at one end 45.

The turntable 1 and print transfer drum 41 are arranged so that the turntable rotates whilst the drum remains stationary, and so that the drum is indexed to bring the next pad into position, only when the insulator 2 has moved clear of the previous pad.

The print transfer device 40 may be provided with some form of cleaner to remove ink from the pads 44 after printing of the insulator 2, and prior to receiving a new inked pattern from the printing head 20.

In operation, the printing head 20 is brought down, into contact with the horizontal top face of the pad 44 on the print transfer device, in the upper position A. The ink pattern on the printing head 20 is identical to the pattern desired to be printed on the insulator 2 and a mirror image of this is deposited onto the face of the pad 44. As the turntable 1 is indexed one place, the print transfer drum 41 is indexed in an anticlockwise sense through 45 degrees so that the ink pad 44 comes to an interim position B. The printing head 20 then inks the next pad. On next indexing the turntable, the pad 44 is rotated through a further 45 degrees anticlockwise so that its inked surface is now inclined vertically. As the inked pad 44 comes to position C, the spark plug insulator 2 on the turntable 1 comes into alignment with the pad. The camming surface 13 forces the roller assembly 10 into contact with the insulator 2 so that it is pinched between the pad 44 and the two rollers 11 and 12. In this way, the insulator 2 is rolled along the inked pad, taking up a mirror image of the pattern on the pad, that is, a pattern the same as that on the printing head 20. The tapered end 45 of the pad 44 helps the insulator 2 move between the rollers 11 and 12 and the pad. Preferably, the pad 44 contacts a different part of the insulator 2 to that contacted by the roller assembly 10, so that the rollers 11 and 12 do not smudge the printed pattern. By engaging the insulator 2 with the rollers 11 and 12 over its corrugated end 4, any tendency for the insulator to rise out of the supporting cup 6 is resisted. The relatively hard nature of the pad 44 prevents it being distorted significantly by the pressure of the insulator, thereby ensuring accurate print transfer.

Because the insulators are printed in a vertical position, they may be directly sprayed with glaze without the need to reorient them, as would be the case if they were printed horizontally, with the attendant risk of smudging the printing during the handling process.

In order to reduce the time required for the ink to dry, the ink may be of the kind which has to be heated in order to make it flow, so that it dries quickly on cooling. In this respect, the ink may have a thermoplastic carrier, the printing head having a heater to raise the temperature of the ink and cause it to flow. The screen of the printing head may be electrically-conductive, the ink being heated by passing current through the screen. In order to prevent the ink drying on the pads 44, each pad is heated, such as by means of an electrical resistance heater. The ink thereby remains fluid whilst on the pads 44, and dries quickly as soon as it contacts the cooler insulator.

By accelerating the drying time of the ink, it is easier to print several colours since less time is required between each printing operation. The need for special drying chambers to dry the ink can also be obviated and overall production time reduced.

It will be appreciated that the invention in its various aspects, is not restricted to use with spark plug insulators but could be used to print onto other bodies.

What we claim is:

1. Printing apparatus for printing onto a substantially cylindrical vertical surface of a body comprising: a screen printing head containing a heat-flowable ink; means for heating said printing head to render the ink flowable; means mounting the head with the screen substantially horizontal; a print transfer device, said print transfer device including a drum that is rotatable about a horizontal axis and a plurality of print transfer pads spaced about the surface of the drum, each said transfer pad having a face thereon extending parallel to the axis of the drum; means for heating each said transfer pad to maintain ink on said pad in a flowable state; means mounting the print transfer device for rotation between a first stationary position in which the face of a pad is substantially horizontal and a second stationary position in which the face of the pad is substantially vertical; means for bringing the face of the pad into contact with the printing head in said first position so as to take up ink from the printing head; and means for rolling the body about a vertical axis along the face of the pad transverse to the direction of displacement of the pad in said second position so as to deposit ink from the pad around the cylindrical surface of the body, said body being unheated such that the ink deposited on the body rapidly dries on cooling.

2. Printing apparatus according to claim 1, wherein the or each said print transfer pad is of a resilient material and has a Shore hardness of between about 55 and 60.

3. Printing apparatus according to claim 1, including roller means that is engageable with the body on a side of the body opposite the print transfer pad.

4. Printing apparatus according to claim 1, wherein the said ink in the printing head is ceramic based.

5. Printing apparatus according to claim 1, wherein the said screen printing head includes an electrically-conductive screen, and wherein the said ink is heated by passing current through the screen.

6. Printing apparatus according to claim 1, wherein the said ink has a thermoplastic carrier.

* * * * *